US010849399B2

(12) United States Patent
Schurman

(10) Patent No.: US 10,849,399 B2
(45) Date of Patent: Dec. 1, 2020

(54) CARRY ITEM SYSTEM FOR RETAINING SEVERAL CARRY ITEMS TOGETHER

(71) Applicant: Kenneth Wayne Schurman, Deerfield Beach, FL (US)

(72) Inventor: Kenneth Wayne Schurman, Deerfield Beach, FL (US)

( * ) Notice: Subject to any disclaimer, the term of this patent is extended or adjusted under 35 U.S.C. 154(b) by 227 days.

(21) Appl. No.: 15/938,804

(22) Filed: Mar. 28, 2018

(65) Prior Publication Data

US 2019/0298027 A1 Oct. 3, 2019

(51) Int. Cl.

| | |
|---|---|
| ***A45C 13/30*** | (2006.01) |
| ***A45C 13/10*** | (2006.01) |
| ***A45C 13/36*** | (2006.01) |
| ***A45C 7/00*** | (2006.01) |

(52) U.S. Cl.

CPC ..... *A45C 13/1069* (2013.01); *A45C 7/0086* (2013.01); *A45C 13/36* (2013.01)

(58) Field of Classification Search

CPC .... A45C 13/1069; A45C 13/36; A45C 7/0086
USPC ..... 190/108, 102; 150/111; 383/37; 206/818; 220/23.4; 335/285, 306
See application file for complete search history.

(56) References Cited

U.S. PATENT DOCUMENTS

| | | | | |
|---|---|---|---|---|
| 4,424,841 | A * | 1/1984 | Smith | A45C 7/0086 190/102 |
| 5,240,106 | A * | 8/1993 | Plath | A45C 5/14 190/102 |
| 6,382,482 | B1 | 5/2002 | Chao | |
| 6,796,344 | B2 | 9/2004 | Chen et al. | |
| 7,322,477 | B2 * | 1/2008 | Schweitz | A45C 7/009 206/579 |
| 7,909,149 | B2 * | 3/2011 | Marji | A45C 7/0045 190/111 |
| 7,985,116 | B2 * | 7/2011 | Song | A63H 33/046 446/129 |
| 8,684,054 | B2 | 4/2014 | Platt et al. | |
| 8,988,876 | B2 | 3/2015 | Corbin et al. | |
| 9,126,313 | B1 | 9/2015 | Peterson | |
| 9,693,614 | B1 | 7/2017 | Brian | |
| 9,821,244 | B1 * | 11/2017 | Whang | A63H 33/046 |

(Continued)

FOREIGN PATENT DOCUMENTS

| | | |
|---|---|---|
| WO | 2017132598 | 8/2017 |

OTHER PUBLICATIONS

Ebay, "Connect Store High Quality Magnetic Glass Salt Pepper Jars Shakers", https://www.ebay.com/itm/Connect-Store-High-Quality-Magnetic-Glass-Salt-Pepper-Jars-Shakers-/12194993083, downloaded on Feb. 13, 2018, pp. 1-3.

*Primary Examiner* — Sue A Weaver
(74) *Attorney, Agent, or Firm* — The Concept Law Group, PA; Scott D. Smiley; Scott M. Garrett

(57) ABSTRACT

A container system includes several carry items or containers for carrying items. The carry items or containers each have a first side and a second side opposite the first side. The carry items or containers include magnetic coupling elements on at least one side to magnetically couple to another one of the carry items or containers. The magnetic coupling elements can be arranged so that a specific orientation of the carry items or containers can be enforced by there not being a magnetic attraction when the items are not properly oriented and aligned.

18 Claims, 10 Drawing Sheets

(56) References Cited

U.S. PATENT DOCUMENTS

| | | | | |
|---|---|---|---|---|
| 2003/0102063 | A1* | 6/2003 | Brody | A45C 7/009 150/104 |
| 2005/0178485 | A1* | 8/2005 | Branson | A45C 3/08 150/113 |
| 2007/0193522 | A1 | 8/2007 | Greschler | |
| 2009/0145711 | A1* | 6/2009 | Panosian | A45C 7/0086 190/107 |
| 2009/0166243 | A1 | 7/2009 | Cetera | |
| 2011/0274376 | A1* | 11/2011 | Evans | A45C 13/02 383/72 |
| 2013/0210753 | A1* | 8/2013 | Squadrito | A61K 31/352 514/27 |
| 2013/0306206 | A1* | 11/2013 | Quinnan | A45C 13/08 150/105 |
| 2014/0069915 | A1* | 3/2014 | Reyes | B65D 21/023 220/23.83 |
| 2014/0128132 | A1 | 5/2014 | Cox, III | |
| 2015/0158633 | A1 | 6/2015 | Aller et al. | |
| 2015/0325352 | A1 | 11/2015 | Lowe | |
| 2016/0353849 | A1 | 12/2016 | Macadaan | |
| 2017/0020250 | A1 | 1/2017 | Boschan | |
| 2017/0057694 | A1* | 3/2017 | Moore | B65D 21/0209 |

* cited by examiner

CARRY ITEM SYSTEM FOR RETAINING SEVERAL CARRY ITEMS TOGETHER

FIELD OF THE INVENTION

The present invention relates generally to luggage and personal items used to carry possessions, and, more particularly, relates to a system for magnetically coupling items together for ease of carrying.

BACKGROUND OF THE INVENTION

People have a need for carrying personal items and find it convenient to use containers, luggage, bags, purses, folios, boxes, and other such carry items or containers with which to carry their items. It is not uncommon for a person to have more than that one such carry item, and often more than two carry items. For example, a person can carry a gym bag, a lunch box, a business folio, and a tablet computer sleeve when leaving home. Many carry items exist for each of these different purposes, separately, making carrying all of them together somewhat difficult. Carry systems exist where separate carry items can be fastened together such as by snaps, zippers, hook and loop fasteners, straps, and so on. The use of such fastening systems requires the addition of fastening components on the outside of carry items, which can detract from the design of the carry items. Accordingly, it is desirable to minimize the presence of such fasteners on carry items.

At the same time, it is well known to use magnets to hold things together. Magnets are commonly used in carry items for various purposes. One of the more common purposes is for closures where, for example, a magnet is placed inside the edge of a flap, hidden, so that it mates with a corresponding magnet or ferrous element hidden inside another portion of the carry item so as to magnetically retain the flap in a closed position. While the flap magnet is sufficient to hold the flap closed, it does not provide a sufficient retention force to hold carry items together. Particularly when there are more than two carry items being carried together.

Therefore, a need exists to overcome the problems with the prior art as discussed above.

SUMMARY OF THE INVENTION

The invention provides a carry item system for retaining several carry items together that overcomes the hereinaforementioned disadvantages of the heretofore-known devices and methods of this general type and that are used to carry personal effects and other things where it is desired to keep the contents of the various carry items separate.

With the foregoing and other objects in view, there is provided, in accordance with some embodiments, a carry item retention system for retaining carry items together which includes at least three carry items, with each carry items including a first end carry item having a first side and a second side. The first side is configured to magnetically couple to another of the at least three carry items. The carry items can further include an intermediate carry item having a first side and a second side, the second side being configured to magnetically couple to the first side of the first end carry item. The carry items can further include a second end carry item having a first side and a second side, the second side being configured to magnetically couple to the first side of the intermediate carry item.

In accordance with some embodiments the first side of the of the first end carry item includes a plurality of magnets disposed at different locations inside a wall of the first side of the first end carry item. The first side of the intermediate carry item includes a plurality of magnets disposed at different locations inside a wall of the first side of the intermediate carry item.

In accordance with some embodiments the second side of the intermediate carry item includes at least one ferrous metal element configured to correspond with the different locations of the plurality of magnets in the wall of the first side of the first end carry item.

In accordance with some embodiments the plurality of magnets inside the wall of the first side of the first carry item are all commonly oriented with respect to a magnetic polarity of the plurality of magnets inside the wall of the first side of the first carry item. The plurality of magnets inside the wall of the first side of the intermediate carry item are all commonly oriented with respect to a magnetic polarity of the plurality of magnets inside the wall of the first side of the intermediate carry item, and further with respect to the magnetic polarity of the plurality of magnets inside the wall of the first side of the first carry item.

In accordance with some embodiments the plurality of magnets inside the wall of the first side of the first carry item are all commonly oriented with respect to a magnetic polarity of the plurality of magnets inside the wall of the first side of the first carry item. The second side of the intermediate carry item includes a plurality of magnets disposed inside a wall of the second side of the intermediate carry item at a location corresponding to a respective one of the plurality of magnets inside the wall of the first side of the first end carry item. The plurality of magnets inside the wall of the second side of the intermediate carry item are all commonly oriented oppositely with respect to the magnetic polarity of the plurality of magnets inside the wall of the first side of the first carry item when the first side of the first end carry item is facing the second side of the intermediate carry item.

The plurality of magnets in the wall of the first side of the first end carry item includes at least four magnets, where each one of the four magnets are disposed in a respective corner of the first side.

The plurality of magnets are disposed in a stiffener disposed inside the wall of the first side of the first end carry item.

In accordance with some embodiments there is provided a container carry system for carrying containers together that includes a plurality of containers, including a first container and a second container. The first container and the second container each having a first side and a second side opposite the first side. The containers further include magnetic coupling elements disposed in the first side and the second side of each of the first container and second container. The magnetic coupling elements are arranged such that the first side of first container will magnetically couple to the second side of the second container, and not the first side of the second container, when the first and second containers are physically aligned. The magnetic coupling elements are further arranged such that the second side of first container will magnetically couple to the first side of the second container, and not the second side of the first container, when the first and second containers are physically aligned.

In accordance with some embodiments the magnetic coupling elements in the first sides of the first and second container include at least one magnet having a first polarity orientation and no other magnets. The magnetic coupling elements in the second sides of the first and second container include at least one magnet having a second polarity orientation that is opposite the first polarity orientation, and no other magnets.

In accordance with some embodiments the magnetic coupling elements in the first sides of the first and second container include at least one magnet. The magnetic coupling elements in the second sides of the first and second container include ferrous metal elements and no magnets.

In accordance with some embodiments further includes a carrier in which the magnetic coupling elements are disposed, which fits in the respective side of the first and second containers.

In accordance with some embodiments the magnetic coupling elements are concealed with the first and second sides of the first and second containers.

In accordance with some embodiments the magnetic coupling elements in the first side of each of the first and second containers includes at least four magnets, where each one of the at least four magnets are disposed in a respective corner of the first side.

In accordance with some embodiments the first and second containers each have a front and a back, wherein a design is disposed across at least one of the front or back of both the first and second containers, and wherein the magnetic coupling elements are configured to couple together when a design portion of the first container is aligned with a design portion on the second container.

In accordance with some embodiments there is provided a container system that includes a plurality of containers, including a first container and a second container, the first container and the second container each having a first side and a second side opposite the first side. The containers further include magnets disposed in the first side of each of the first container and second container, and magnetic coupling elements disposed in the second side of each of the first container and the second container that are arranged to correspond with positions of the magnets disposed in the first sides of the first and second containers when the first and second containers are aligned together for carrying. The magnetic coupling elements in the second sides of the first and second containers is one of a ferrous metal element or a magnet.

In accordance with some embodiments the magnetic coupling elements include at least one magnet having an opposite polarity to a corresponding magnet of the first side.

In accordance with some embodiments the magnets and the magnetic coupling elements are concealed within the respective sides of the first and second containers.

In accordance with some embodiments the first and second containers each have a front and a back, wherein a design is disposed across at least one of the front or back of both the first and second containers, and wherein the magnets and magnetic coupling elements are configured to couple together when a design portion of the first container is aligned with a design portion on the second container.

In accordance with some embodiments the magnetic coupling elements of the second side of the first and second containers are magnets having an opposite polarity to corresponding magnets on the first sides of the first and second containers.

Although the invention is illustrated and described herein as embodied in a carry item retention system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
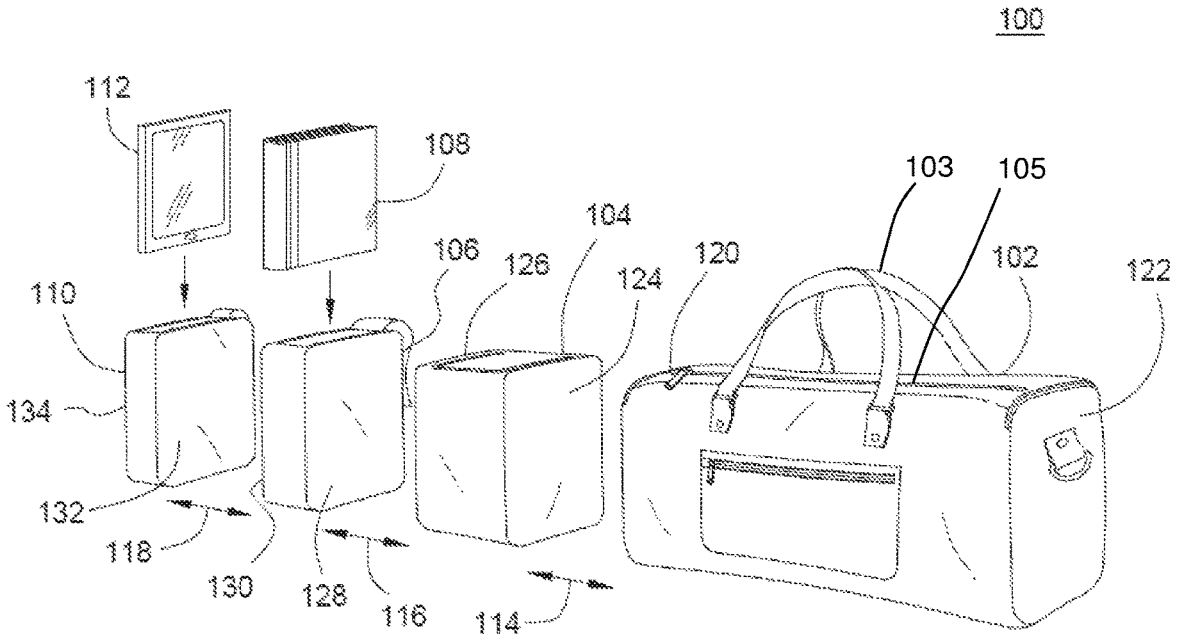
FIG. 1 is a perspective view of a carry item system including several carry items that magnetically couple to each other to be retained together, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient carry item retention system Embodiments of the invention provide a system of related carry items that couple together magnetically. In addition, embodiments of the invention provide a carry item system where the magnetic attraction created between carry items can be configured to enforce a particular orientation or order of the carry items, relative to each other.

Referring now to FIG. 1, some embodiments of the present invention are shown in a perspective view of a carry item system 100 including several carry items that magnetically couple to each other at respective major exterior surfaces, to be retained together. In general each carry item is a container in which items are placed to be kept together and carried together, and which are best kept separate from items in other containers. For example, a person would not normally carry food (e.g. a lunch) in a container used to carry exercise apparel. Each carry item has sides in which magnetic coupling elements can be disposed. In the system, some carry items are designed to be at an end of a series of magnetically coupled carry items, and only require magnetic coupling elements on one side. Other carry items can have magnetic coupling elements on two opposing sides. The magnetic coupling elements can be magnets, or ferrous metal elements that are positioned in one carry item to mate with magnets in another carry item. On these intermediate carry items an orientation can be enforced by orienting the magnets on the sides such that the magnets repel in an incorrect orientation relative to another carry item, while the magnets on an opposite side are oriented to attract.

In the system 100 exemplified in FIG. 1, there is a first end carry item 102, a first intermediate carry item 104, a second intermediate carry item 106, and a second end carry item 110. The first and second end carry items 102, 110 are intended to go on respective ends of the series of carry items when coupled together. First end carry item 102 can be, for example, an exercise/athletic bag in which apparel and other related equipment can be carried. The first end carry item 102 can include a strap or handle 103 on the top 105 of the item 102. The first intermediate carry item 104 can be, for example, a food container (e.g. "lunch box"). The second intermediate carry item 106 can be a folio for carrying papers, documents, supplies, or items such as a book 108. The second end item 110 can be a sheath or sleeve for a tablet or similar computing device 112. The carry items 102, 104, 106, 110 can be arranged horizontally as shown, and moved into proximity against each other, as indicated by arrows 114, 116, 118, where magnetic attraction between the carry items 102, 104, 106, 110 acts to retain them together. The magnetic attraction is created by the arrangement of magnetic coupling elements or components at the side(s) of the carry items that attract each other together when placed in proximity to each other. Once so arranged and coupled together, they can be carried substantially as a unit. In some embodiments a strap can be used to further hold the carry items 102, 104, 106, 110 together and allow them to be carried by a user.

The carry items each have at least two opposing sides: first end carry item 102 has first side 120 and second side 122; first intermediate carry item 104 has a first side 126 and a second side 124 second intermediate carry item 106 has a first side 130 and a second side 128; and second end item 110 has a first side 134 and a second side 132. In general, on the sides that couple together, the first side of one carry item couples to the second side of another carry item. The carry items can each be made with various external materials. For example, the external material can be woven nylon, cloth, or rigid polymeric materials, to name a few examples. In some embodiments the carry items can be configured to be joined together further with a carry strap that allows a user to carry the magnetically coupled carry items together. The strap can, for example, pass through an eyelet or join to a clip, or similar structure in each carry item.

Figure 2:
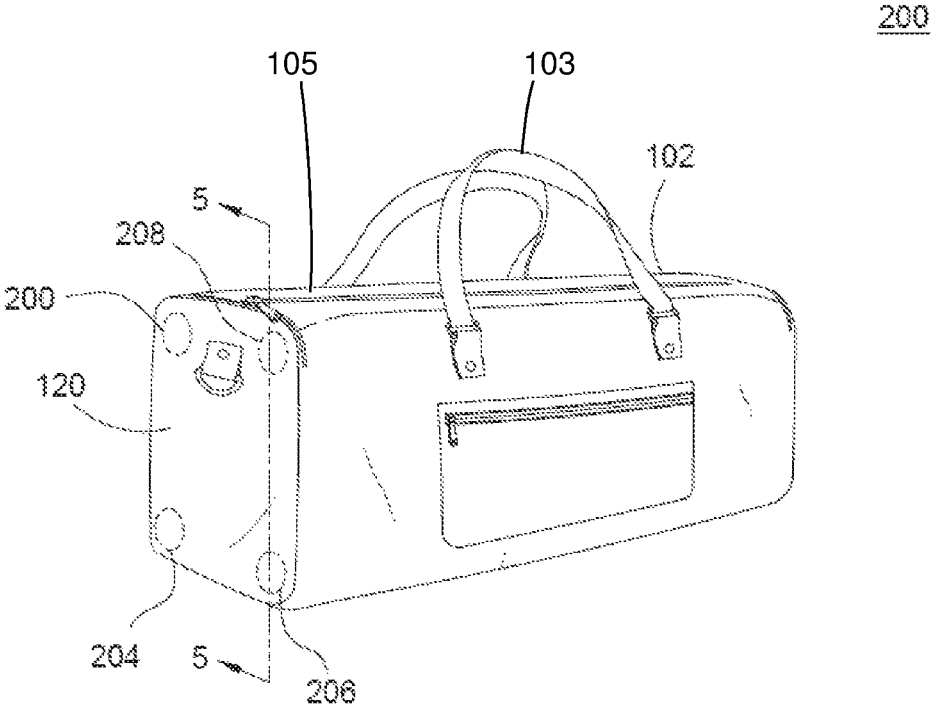
FIG. 2 is an end perspective view of a carry item having magnets disposed on a side of the carry item to magnetically couple to another carry item of a carry item retention system, in accordance with some embodiments.

FIG. 2 is an end perspective view of a carry item having magnets disposed on a side of the carry item to magnetically couple to another carry item of a carry item retention system, in accordance with some embodiments. In particular FIG. 2 shows first end carry item 102 shown in FIG. 1. On the first side 120 there are a plurality of magnets 200-208 disposed inside the wall of the side. The magnets can be mounted in a variety of ways, including being sewn into the fabric of the first side (e.g. captured within stiches), glued in place, held by a carrier, and so on. The magnets 200-208 can be concealed with the sidewall of their respective carry item, or exposed at the outside surface of their respective carry item. In the particular example shown the first side 120 include 4 magnets disposed at respective corners of the first side 120, which is square or rectangular. The magnets 200-208 can be of a size and type sufficient to retain the first end carry item 102 together with first intermediate carry item 104, and other carry items. The magnets 200-208 become attracted to a corresponding structure in the second side of another carry item, such as first intermediate carry item 104. This arrangement can be duplicated among the other carry items in the system. The configuration and/or number of magnets can vary as well.

Figure 3:
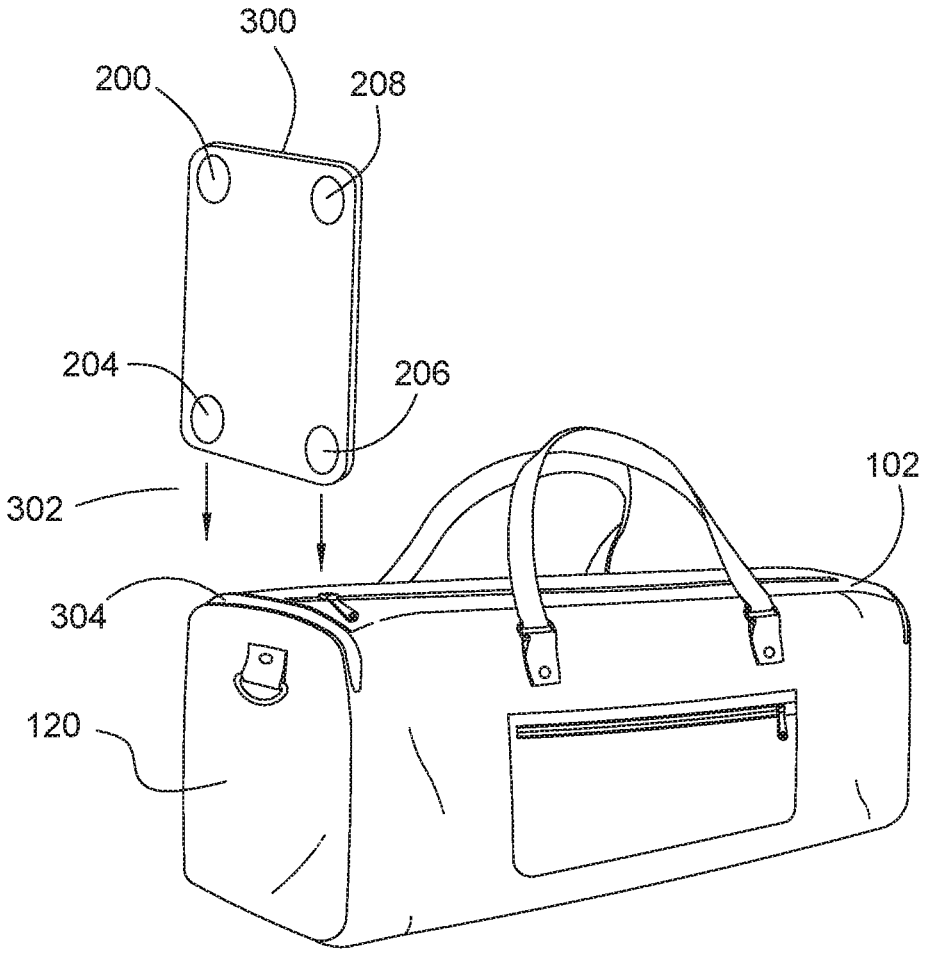
FIG. 3 is an end perspective view of a carry item showing how a carrier including a plurality of magnets is placed in the wall of a side of a carry item, in accordance with some embodiments.

FIG. 3 is an end perspective view of a carry item showing how a carrier including a plurality of magnets can be placed in the wall of a side of a carry item, in accordance with some embodiments. In this example the first carry item 102 has space 304 in the first side 120 in which a carrier 300 including magnets 200-208 can be placed and secured, as indicated by arrow 302. The space 304 can be, for example, between an interior and an exterior portion or fabric forming a wall at the first side 120. The carrier 300 can be made of a non-ferrous material, such as a polymeric or paper-based material in which the magnets 200-208 are affixed, such as by an adhesive. By placing the magnets 200-208 within the wall of the side 120, they can be hidden from view.

Figure 4:
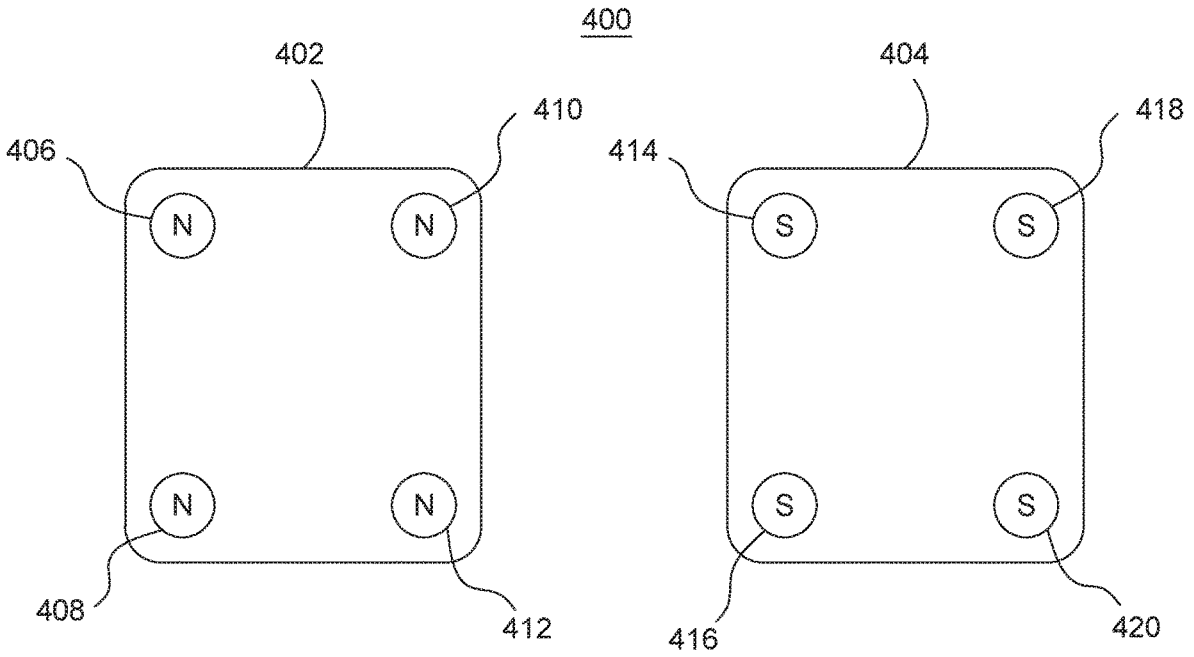
FIG. 4 shows end views of two carry items having magnets of opposite polarities which become aligned when the carry items are placed together, end to end, in accordance with some embodiments.

FIG. 4 shows end views of a system 400 including two carry items 402, 404 having magnets of opposite polarities which become aligned when the carry items are placed together, end to end, in accordance with some embodiments. Carry item 402 includes magnets 406-412, and carry item 404 includes magnets 414-420. The magnets 406-420 are shown exposed in the respective sides of the carry items 402, 404 but can be hidden from view, as in FIG. 3. The magnets 406-412 of carry item 402 can be arranged with respect to their magnetic polarity such that their north pole is facing outwards from the carry item 402. Likewise, in carry item 404, magnets 414-420 can be oriented such that their south pole is facing outwards. Furthermore, magnets 406-412 and 414-420 can be arranged such that when the sides of the carry items 402, 404 shown are moved together, each one of the magnets 406-420 correspond in location/position, respectively, with one of the magnets 414-420, and the magnetic attraction would retain the two carry items 402, 404 together. For example, if the carry items 402, 404 were each swiveled about their vertical edges closest to each other, with the outer edges coming out of the page, magnet 406 would align with magnet 418, magnet 410 would align with magnet 414, and so on. The polarity of the magnets can be used to enforce an orientation of the carry items 402, 404 with respect to each other. For example, if carry item 402 has magnets in a side opposite the one in view here, where magnets 406-412 are located, located in the same positions, but with their south pole facing outwards, then that other side would not be retained with the side of carry item 404 in view here as the south pole polarities of the magnets would repel each other. It will be appreciated that, while the magnetic coupling elements shown here appear to be visible, they can also be concealed behind a layer of fabric or other material.

Figure 5:
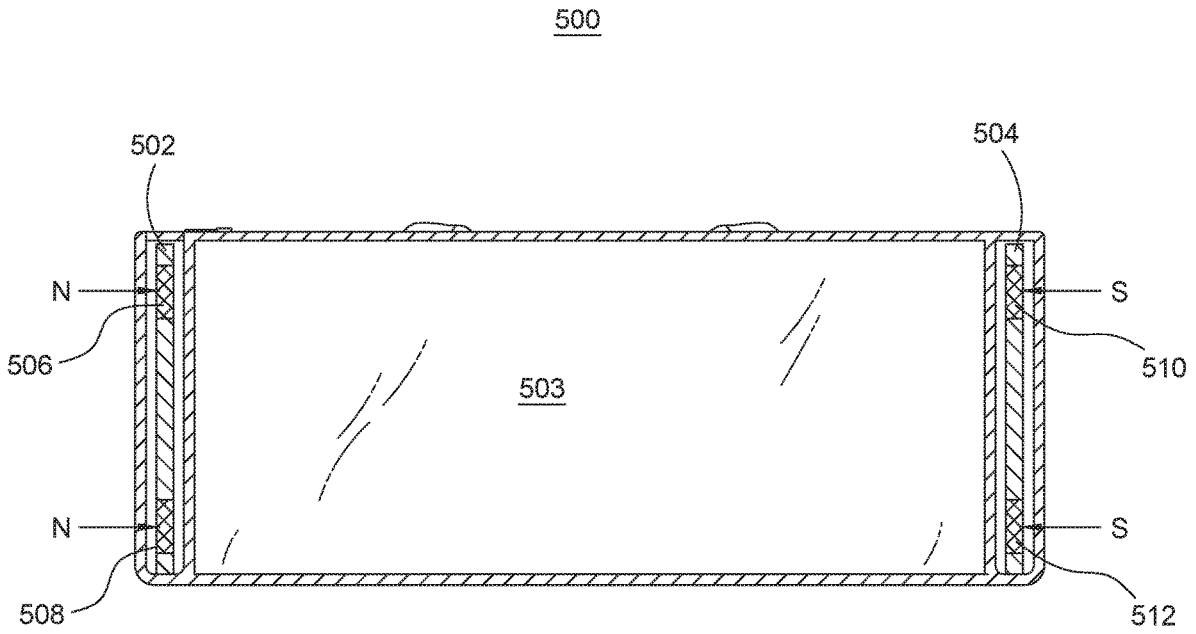
FIG. 5 shows a side cutaway view of a carry item having magnets disposed at each of two opposing ends of the carry item, in accordance with some embodiments.

FIG. 5 shows a side cutaway view of a carry item 500 having magnets disposed at each of two opposing ends of the carry item, in accordance with some embodiments. The carry item 500 can represent one of the intermediate carry items such as 104, 106 of FIG. 1, and includes a first side 502, and a second side 504. The carry item 500 has an interior volume 503 in which items can be placed to be carried together. The first side 502 can have several magnets 506, 508 which have their north poles facing outward. The second side 504 can likewise have several magnets 510, 512 that are oriented with their south poles facing outward. Thus, the first side 502 will only be attracted to, and retained with, the side of another carry item having magnets located in the same relative positions of magnets 506, 508 with their south poles facing outwards. By arranging the magnets in the several carry items, as shown here, a desired orientation can be enforced so that, for example, an exterior ornamental design can be maintained. For example, the exterior ornamental design can include a logo or tradename that spans the exposed sides of the several carry items when retained together, so that the design is complete when the several carry items are placed together in a correct orientation. Further, in addition to the polarity of the magnets being used to enforce an orientation of the individual carry items with respect to each other, the positions of the magnets can be varied to create unique magnetic interfaces between particular sides of carry items to also enforce an order of the carry items with respect to each other. Thus, for example, as shown in FIGS. 2-4, one positioning of magnets can be to locate four magnets such that there is one in each corner of the side of a carry time. But at an opposite side of the carry item, the magnets can be located at middle of each edge of the side, rather than in the corners.

Figure 6:
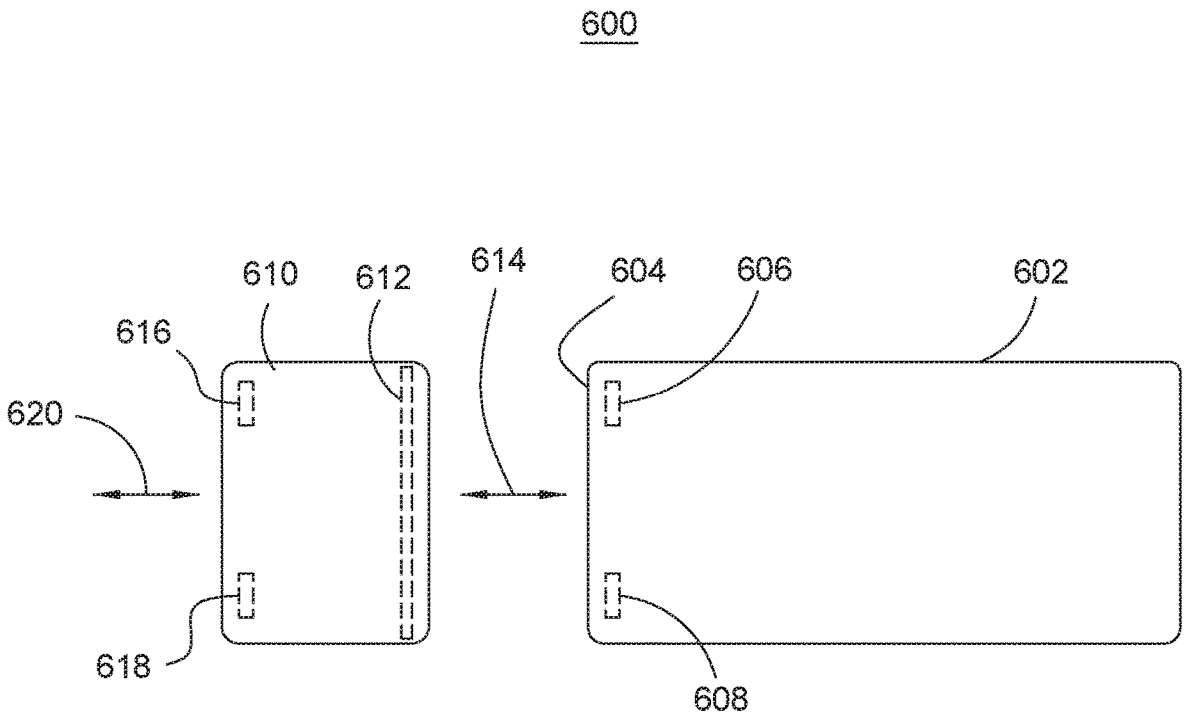
FIG. 6 shows a side view of two carry items of a carry item system which can be magnetically coupled to each other for carrying by a user, in accordance with some embodiments.

FIG. 6 shows a side view of two carry items 602, 610 of a carry item system 600 which can be magnetically coupled to each other for carrying by a user, in accordance with some embodiments. The system 600 uses a ferrous metal element rather than magnets at one side of a carry item for magnetic coupling. The use of the ferrous metal element can reduce the cost of producing a carry item system, in some embodiments. The first carry item 604 has a first side 604 at which there are several magnets 606, 608 disposed. The magnets 606, 608 are arranged to magnetically couple with a ferrous metal element 612 provided at a second side of a second carry item 610. When the first side 604 of the first carry item 602 is placed in magnetic proximity to the second side of the second carry item 610, a magnetic attraction 614 occurs between the magnets 604, 608 and the ferrous metal element 612 with a force sufficient to retain the first and second carry items 602, 610 together. The ferrous metal element 612 can be a unitary element that substantially spans the height and width of the side of the carry item 610, or it can include several individual ferrous metal elements disposed in correspondence with the locations of magnets 606, 608. Similarly, the second carry item 610 can have magnets 616, 618 at its first/left side to create a magnetic attraction 620 with another carry item, either with other magnets or another ferrous metal element. In some carry items, such as those that are intended to be on an end of a series of carry items, the carry item may have only one side that has either magnets or a ferrous metal element.

Figure 7:
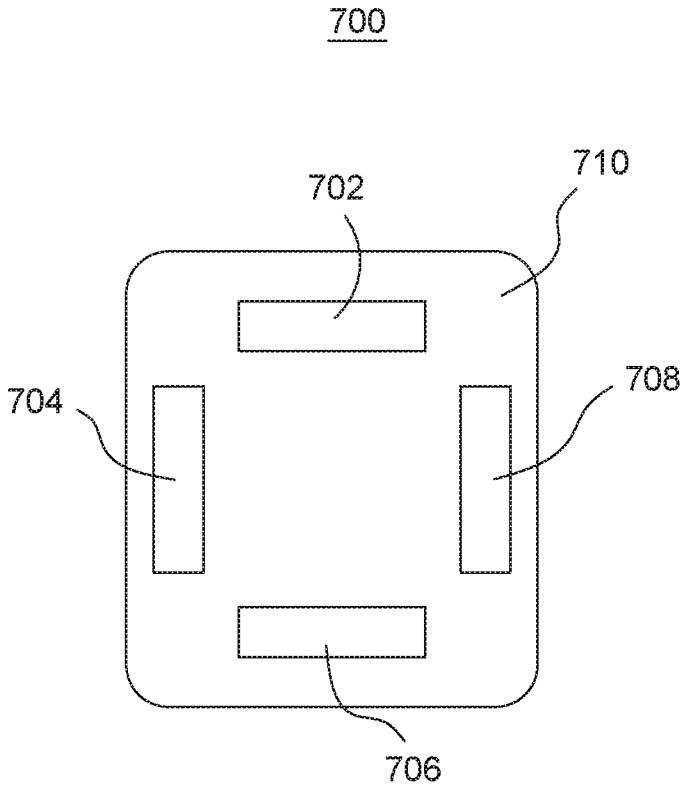
FIG. 7 shows a side view of a carry item having a plurality of magnetic coupling elements disposed therein, in accordance with some embodiments.

FIG. 7 shows a side view of a carry item 700 having a plurality of magnetic coupling elements disposed therein, in accordance with some embodiments. The magnetic coupling elements can include rectangular elements 702, 704, 706, 708 that are arranged on the sides, rather than in the corners, of the side 710 of the carry item 700. It is contemplated that various arrangements of magnets, polarity orientations, and ferrous metal elements can be arranged in various combinations on the sides. It will be appreciated that, while the magnetic coupling elements shown here appear to be visible, they can also be concealed behind a layer of fabric or other material.

Figure 8:
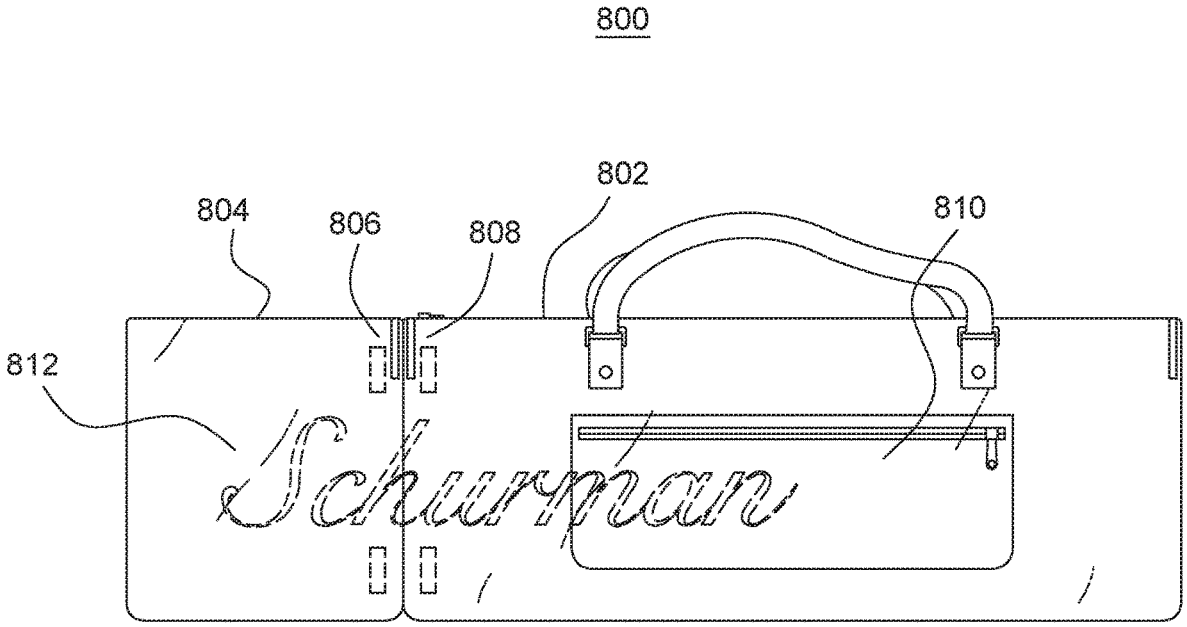
FIG. 8 shows a view of two carry items magnetically coupled together such that an orientation of the items with respect to each other is enforced so that a design that spans the carry items is properly arranged.

FIG. 8 shows a view 800 of two carry items 802, 804 magnetically coupled together such that an orientation of the items with respect to each other is enforced so that a design that spans the carry items is properly arranged. The two carry items 802, 804 are coupled together at corresponding sides 806, 808. A design, such as a logo, image, text, or similar indicia can be arranged across the front or back, or both, of the carry items. A first portion 810 being shown on carry item 802 and a second portion 812 being shown in carry item 804. If one of the carry items were reversed, then the design portions 810, 812 would not align. Thus, by arrangement the magnetic coupling elements at the sides 806, 808 to enforce a particular orientation, or order of arrangement, the design portions 810, 812 will appear properly arranged.

Figure 9:
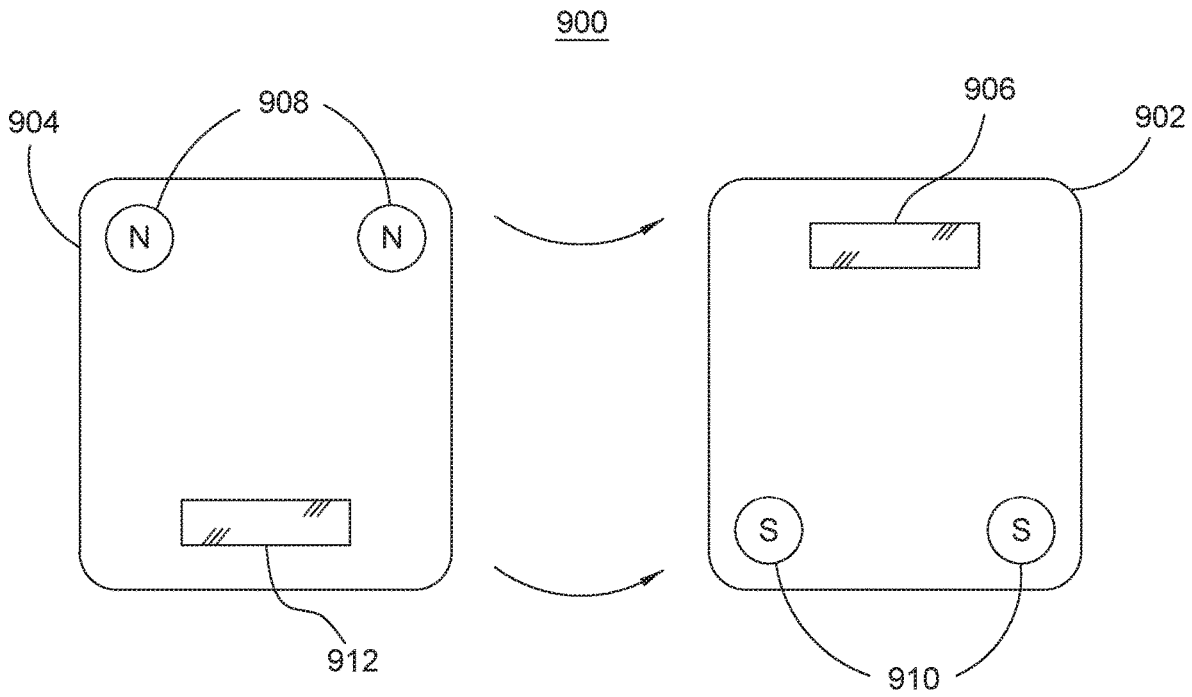
FIG. 9 shows a side view of two carry items of a carry item system which can be magnetically coupled to each other for carrying by a user, in accordance with some embodiments.

FIG. 9 shows a side view of two carry items 902, 904 of a carry item system 900 which can be magnetically coupled to each other for carrying by a user, in accordance with some embodiments. Specifically, the second side of carry item 902 and the first side of carry item 904 are shown. The system 900 shows an alternative way to arrange magnetic coupling elements to enforce an orientation of carry items with respect to each other. On carry item 902 and ferrous metal element 906 is disposed near the top of the side, and two magnets 910 are arranged in the lower left and right corners. The ferrous metal element 906 corresponds with the location of two magnets 908 of the second carry item 904 when the sides shown here are placed together. Likewise, a ferrous metal element 912 corresponds with, and magnetically couples to, magnets 910 when the sides shown are coupled together. In general, when additional carry items are included in the system 900, they can be configured so that every carry item has one side including magnetic coupling elements as arranged as shown here on the side of carry item 902, and an opposing side having magnetic coupling elements arranged as shown on the side of carry item 904. The magnets 908, 910 can be arranged with respect to their polarity so that if two sides having the same arrangement are put together, they will repel, rather than attract. And of course, there will be no magnetic attraction between two ferrous metal elements placed together. It will be appreciated that, while the magnetic coupling elements shown here appear to be visible, they can also be concealed behind a layer of fabric or other material.

Figure 10:
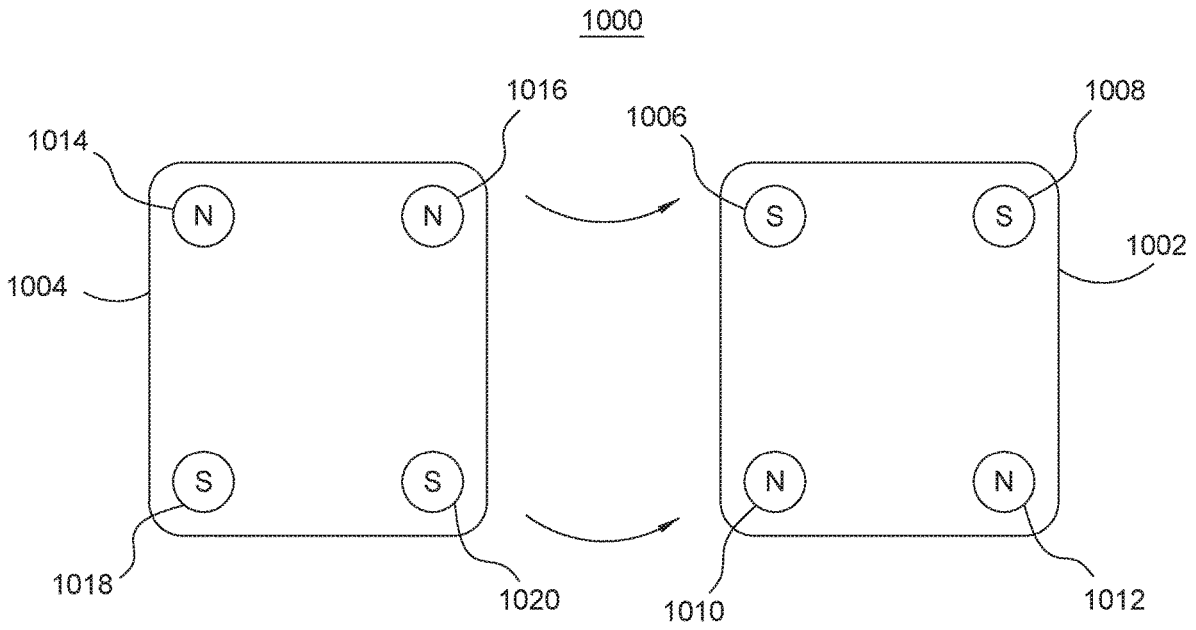
FIG. 10 shows a side view of two carry items of a carry item system which can be magnetically coupled to each other for carrying by a user, in accordance with some embodiments.

FIG. 10 likewise shows a side view of two carry items 1002, 1004 of a carry item system 1000 which can be magnetically coupled to each other for carrying by a user, in accordance with some embodiments. Carry item 1002 includes magnets 1006-1012, arranged with different polarities. Magnets 1006 and 1008 are oriented with the south poles outwards, and magnets 1010, 1012 are oriented with their north pole outwards. Similarly, the magnets 1014-1020 on the second carry item 1004 are arranged with the top magnets 1014, 1016 oriented with the north poles outward, and the lower magnets 1018, 1020 are oriented with the south poles oriented outward. Accordingly, the sides shown in this view of system 1000 will magnetically couple when placed together. However, two sides arranged as shown in carry item 1002, or two sides arranged as shown on carry item 1004, will not properly couple together, magnetically, because of the common orientation of the magnets at the corresponding locations. Similarly, rather than commonly orienting the polarity of magnets at the top and at the bottom, magnets at the left and right sides can be commonly oriented with respect to their magnetic polarity to enforce a proper orientation of the carry items with respect to each other. It will be appreciated that, while the magnetic coupling elements shown here appear to be visible, they can also be concealed behind a layer of fabric or other material.

In accordance with inventive carry item retention system there is disclosed a system include multiple carry items that can magnetically couple to each other. The carry items have magnets provided on at least one magnetically attractive elements, either magnets or a ferrous metal element, disposed on at least one side of the carry item. Some carry items can be designed to be arranged on an end of the series of carry items when the carry items are placed and coupled together. Thus, the carry item system disclosed herein solves the problem of carrying multiple carry items together by coupling them together magnetically, which greatly reduces the difficulty of carrying multiple carry items. Carry items systems can be configured such that there are just two carry items in the system that magnetically couple together, or more than two carry items that magnetically couple together. In some embodiments the carry item systems can have their magnetic couple elements arranged to enforce an orientation of the carry items with respect to each other, and in some embodiments the magnetic coupling elements can be arranged so that the carry items magnetically couple together without regard to orientation of the carry items with respect to each other.

What is claimed is:

1. A carry item retention system for retaining carry items together, comprising:

at least three carry items including:

a first end carry item having a first side and a second side, wherein the first side includes a plurality of magnets configured to magnetically couple to another of the at least three carry items, wherein each one of the plurality of magnets is disposed at a different locations in a stiffener disposed in a wall of the first side;

an intermediate carry item having a first side and a second side, the second side including a plurality of magnetic elements configured to magnetically couple to the plurality of magnets of the first side of the first end carry item, the first side of the intermediate carry item including a plurality of magnetic elements disposed at different locations inside a wall of the first side of the intermediate carry item;

a second end carry item having a first side and a second side, the second side being including a plurality of magnetic elements configured to magnetically couple to the plurality of magnetic elements of the first side of the intermediate carry item;

wherein at least one of the plurality of magnetic elements of the second side of the second end carry item or the plurality of magnetic elements of the first side of the intermediate carry item are magnets.

2. The carry item retention system of claim 1, wherein the second side of the intermediate carry item includes at least one ferrous metal element configured to correspond with the different locations of the plurality of magnets in the wall of the first side of the first end carry item.

3. The carry item retention system of claim 1, wherein:

the plurality of magnets inside the wall of the first side of the first carry item are all commonly oriented with respect to a magnetic polarity of the plurality of magnets inside the wall of the first side of the first carry item; and wherein the plurality of magnets inside the wall of the first side of the intermediate carry item are all commonly oriented with respect to a magnetic polarity of the plurality of magnets inside the wall of the first side of the intermediate carry item, and further with respect to the magnetic polarity of the plurality of magnets inside the wall of the first side of the first carry item.

4. The carry item retention system of claim 1, wherein:

the plurality of magnets inside the wall of the first side of the first carry item are all commonly oriented with respect to a magnetic polarity of the plurality of magnets inside the wall of the first side of the first carry item; and the second side of the intermediate carry item includes a plurality of magnets disposed inside a wall of the second side of the intermediate carry item at a location corresponding to a respective one of the plurality of magnets inside the wall of the first side of the first end carry item, and wherein the plurality of magnets inside the wall of the second side of the intermediate carry item are all commonly oriented oppositely with respect to the magnetic polarity of the plurality of magnets inside the wall of the first side of the first carry item when the first side of the first end carry item is facing the second side of the intermediate carry item.

5. The carry item retention system of claim 1, wherein the plurality of magnets in the wall of the first side of the first end carry item includes at least four magnets, where each one of the four magnets are disposed in a respective corner of the first side.

6. A container carry system for carrying containers together, comprising:

a plurality of containers, including a first container and a second container, the first container and the second container each having a first side and a second side opposite the first side, the first container having a carry handle on a top of the first container;

magnetic coupling elements disposed in the first side and the second side of each of the first container and second container, wherein the magnetic coupling elements are arranged such that the first side of first container will magnetically couple to the second side of the second container, and repel the magnetic coupling elements of the first side of the second container, when the first and second containers are physically aligned; and wherein the magnetic coupling elements are further arranged such that the second side of first container will magnetically couple to the first side of the second container, and repel the magnetic coupling elements of the second side of the first container, when the first and second containers are physically aligned.

7. The container carry system of claim 6, wherein:

the magnetic coupling elements in the first sides of the first and second container include at least one magnet having a first polarity orientation and no other magnets; and the magnetic coupling elements in the second sides of the first and second container include at least one magnet having a second polarity orientation that is opposite the first polarity orientation, and no other magnets.

8. The container carry system of claim 6, wherein:

the magnetic coupling elements in the first sides of the first and second container include at least one magnet; and the magnetic coupling elements in the second sides of the first and second container include ferrous metal elements and no magnets.

9. The container carry system of claim 6, further comprising a carrier in which the magnetic coupling elements are disposed, which fits in the respective side of the first and second containers.

10. The container carry system of claim 6, wherein the magnetic coupling elements are concealed with the first and second sides of the first and second containers.

11. The container carry system of claim 6, wherein the magnetic coupling elements in the first side of each of the first and second containers includes at least four magnets, where each one of the at least four magnets are disposed in a respective corner of the first side.

12. The container carry system of claim 6, wherein the first and second containers each have a front and a back, wherein a design is disposed across at least one of the front or back of both the first and second containers, and wherein the magnetic coupling elements are configured to couple together when a design portion of the first container is aligned with a design portion on the second container.

13. A container system, comprising:

a plurality of containers, including a first container and a second container, the first container and the second container each having a first side and a second side opposite the first side the first container having a carry handle on a top of the first container;

magnets disposed in the first side of each of the first container and second container, and magnetic coupling elements disposed in the second side of each of the first container and the second container that are arranged to correspond with positions of the magnets disposed in the first sides of the first and second containers when the first and second containers are aligned horizontally together for carrying; and wherein each the magnetic coupling elements in the second sides of the first and second containers is one of a ferrous metal element or a magnet.

14. The container system of claim 13, wherein, the magnetic coupling elements include at least one magnet having an opposite polarity to a corresponding magnet of the first side.

15. The container system of claim 13, wherein the magnets and the magnetic coupling elements are concealed within the respective sides of the first and second containers.

16. The container system of claim 13, wherein the first and second containers each have a front and a back, wherein a design is disposed across at least one of the front or back of both the first and second containers, and wherein the magnets and magnetic coupling elements are configured to couple together when a design portion of the first container is aligned with a design portion on the second container.

17. The container system of claim 13, wherein the magnetic coupling elements of the second side of the first and second containers are magnets having an opposite polarity to corresponding magnets on the first sides of the first and second containers.

18. The container system of claim 13, further comprising a third container having a first side having magnetic coupling elements and a second side opposite the first side that does not include any magnetic coupling elements.

* * * * *